United States Patent [19]

Grow

[11] 4,205,528

[45] Jun. 3, 1980

[54] COMPRESSION IGNITION CONTROLLED FREE PISTON-TURBINE ENGINE

[76] Inventor: Harlow B. Grow, 16530 Chattanooga Pl., Pacific Palisades, Calif. 90272

[21] Appl. No.: 958,184

[22] Filed: Nov. 6, 1978

[51] Int. Cl.[2] ..... F02B 71/00

[52] U.S. Cl. ..... 60/595; 123/46 A

[58] Field of Search ..... 60/595, 605; 123/32 E, 123/46 R, 46 A

[56] References Cited

U.S. PATENT DOCUMENTS

| | | | |
|---|---|---|---|
| 1,620,565 | 3/1927 | McKeown | 123/46 A |
| 2,693,076 | 11/1954 | Francis | 123/46 A X |
| 2,943,610 | 7/1960 | Foster | 60/595 X |
| 2,944,535 | 7/1960 | Fikse | 123/46 R |

FOREIGN PATENT DOCUMENTS

| | | | |
|---|---|---|---|
| 447855 | 5/1936 | United Kingdom | 60/595 |
| 850978 | 10/1960 | United Kingdom | 60/595 |

*Primary Examiner*—Michael Koczo

*Attorney, Agent, or Firm*—William H. Maxwell

[57] ABSTRACT

A fuel injected free piston-turbine heat engine wherein a piston moves reciprocally within a cylinder to deliver gases to an impulse turbine powering a fan-scavenged two-stroke cycle operation of said piston, there being a low compression storage chamber of substantial volume normally open into the cylinder and closed by upward movement of the piston to withhold gases at combustion supporting temperature, there being a high compression auto ignition chamber of limited volume comprising the upper portion of the cylinder and isolated from said low compression chamber by said piston closure thereof for continued compression of combustion supporting gases by said piston movement to auto ignition temperature, and there being constant volume fuel injection means for injecting fuel at high pressure into the auto ignition chamber and at a progressively diminishing rate as the first mentioned storage chamber is re-opened and as the cylinder pressure decreases during the effective power stroke.

24 Claims, 5 Drawing Figures

COMPRESSION IGNITION CONTROLLED FREE PISTON-TURBINE ENGINE

BACKGROUND

The prior art accepts free piston internal combustion engines operating on both the Otto cycle and Diesel cycle principle, the former being constant volume and the latter being constant pressure, in theory. It is the latter constant pressure concept with which this invention is concerned; with engines that compress the full cylinder volume and inject fuel during piston travel. At the present state of the art compression ignition engines, Diesels, are acknowledged to compress 40% excess air in order to establish auto ignition temperature, and although this has its benefits in providing more than adequate support for combustion, it has great disadvantages in the waste of energy provided for the compressive function and in the increased structural requirements of large volume high compression engines; and all of which involves inefficiency which entails friction and heat losses. Therefore, it is an object of this invention to provide a free piston heat engine wherein a substantial portion of the compression is restricted to low pressure for support of combustion, wherein a limited portion of the compression is extended to high pressure for establishing auto ignition, and wherein combustion gases are extracted for delivering power in the form of heat and/or torque. With the concept herein disclosed, the aforementioned 40% excess air is reduced to a minumum and/or to a small excess, say for example 10% to 15% or less as may be desired; and combustion gases are by-passed to an impulse turbine during the piston power stroke, sufficient to drive a scavenger blower and to provide a torque drive as circumstances require.

The engine of the present invention is a departure from both the Otto cycle and Diesel cycle concepts in that full volume compression and measured fuel injection at the beginning of the power stroke are avoided. Replacing the foregoing is controlled injection as it is disclosed in my U.S. Pat. No. 4,070,998 entitled Compression Ignition Controlled Pressure Heat Engine, issued Jan. 31, 1978. To this end it is an object of this invention to continuously inject fuel in a free piston engine throughout the effective portion of the work stroke, at a controlled rate establishing burning pressures less than the pressure of the aforementioned storage air that is thereby releasable from the aforementioned storage member to support combustion within the cylinder.

An object of this invention is to advantageously employ the constant volume variable potency injectors as disclosed in U.S. Pat. Nos. 3,749,097 and 3,921,599 issued to me on July 31, 1973 and Nov. 25, 1975 respectively. It is by means of these fuel injectors, or like injectors, that controlled fuel burning and cylinder pressures are maintained below the stored combustion supporting air pressures. With this invention a constant volume pump intermixes two liquids and discriminately injects the admixture thereof discretely therefrom and into the engine cylinder at a controlled potency. The injector per se is characterized by its differential pump means which are advantageously employed to acquire structural strength and accurately metered fuel injection.

FIELD OF INVENTION

This invention relates to the improvement of a blower scavenged free piston internal combustion engine wherein intake gases for support of combustion are compressed to auto ignition temperature, and in accordance with this invention a substantial volume of said gases is stored at low compression while a minimized volume thereof is highly compressed to auto ignition temperature. This concept is particularly applicable to two cycle operation as depicted in the Pressure Volume diagram of FIG. 4 where it will be seen that the compression function of the diagram is characterized by a volume storage line a where a compressed volume is stored at a pressure, while the compression curve continues as indicated by line b to compress a remaining volume to auto ignition temperature. Continuing its power function, the diagram of FIG. 4 depicts the compression ignition of injected fuel, followed by continued combustion supported by the aforesaid stored compressed volume of intake gases and depicted by line c representing cylinder pressure and by line d representing storage chamber pressure. Notice that the latter storage chamber pressure d exceeds the former cylinder pressure c at all times, so that there will be flow from said chamber into the cylinder where combustion takes place. A feature of this engine concept is the controlled injection through the use of variable potency fuel injected throughout the power stroke, only a small portion of the fuel being injected into the auto ignition chamber and the greater portion of the fuel being injected as required to burn stored air and to maintain the cylinder pressure curve c. The area within the diagram envelope represents the power, the primary purpose of this Controlled Pressure concept being to obtain compression ignition without subjecting the engine to the compression ignition pressures that heretofore resulted from the handling of 40% excess air. Further, by controlled potency and rate of fuel injection, a diminishing pressure heat engine with improved power output is realized.

DRAWINGS

The various objects and features of this invention will be fully understood from the following detailed description of the typical preferred form and application thereof, throughout which description reference is made to the accompanying drawings, in which.

PREFERRED EMBODIMENT

Figure 4:
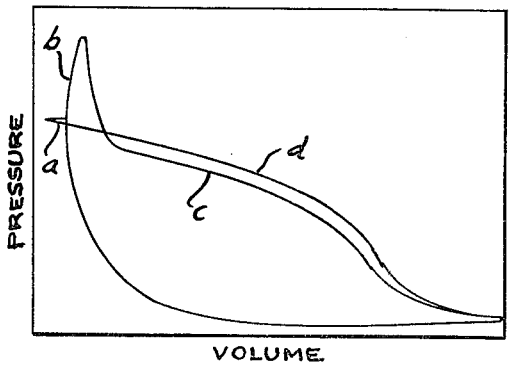
FIG. 4 is a Pressure Volume diagram illustrating the operation of the Diesel Cycle.
Figure 5:
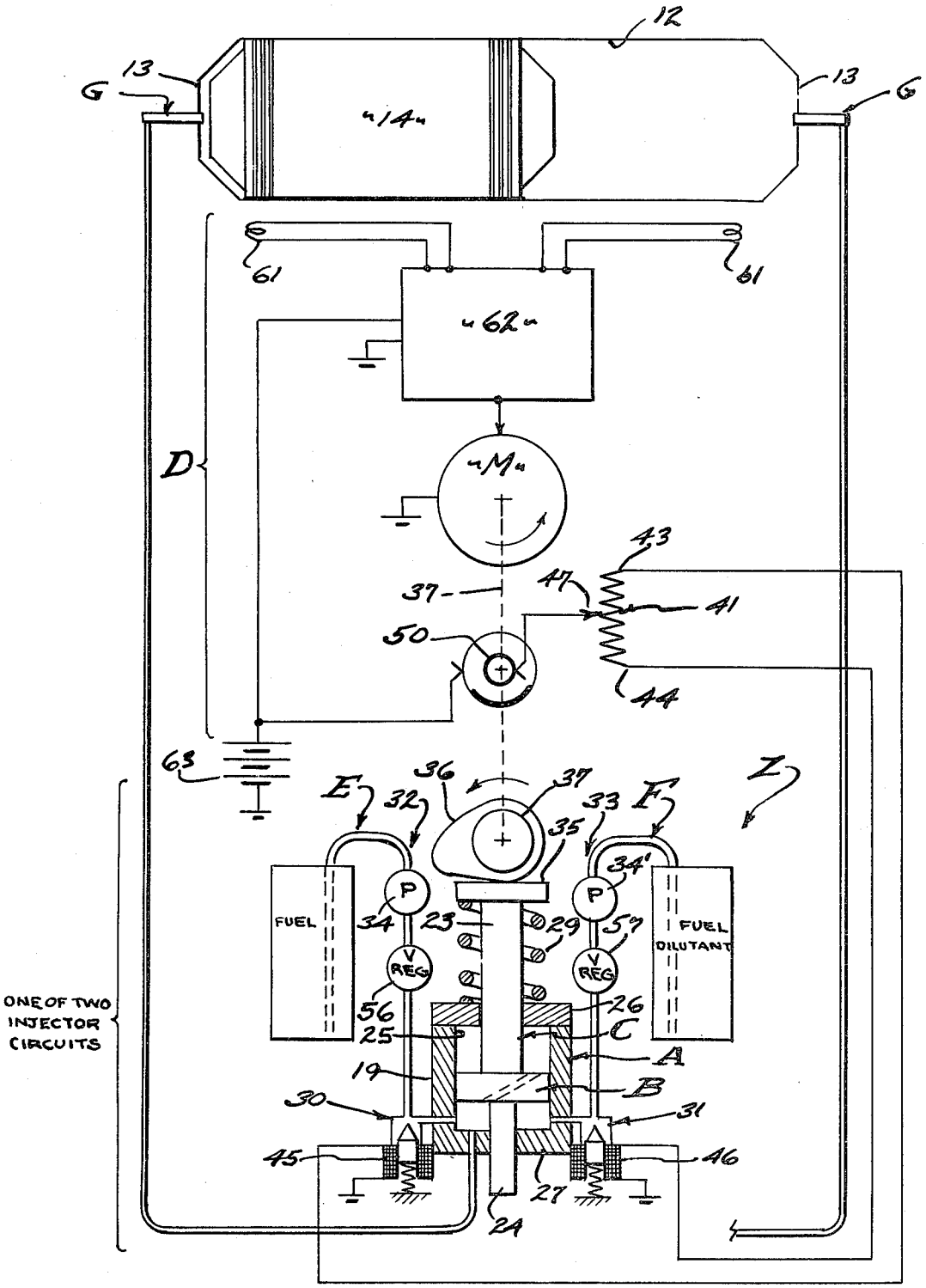
FIG. 5 is a schematic diagram illustrating the full stroke fuel pump means.

This disclosure requires an understanding of the Pressure Volume diagrams as they are depicted graphically on indicator cards and as shown in FIG. 4 of the drawings. The envelope curve illustrates that is generally referred to as the "constant pressure" Carnot Cycle of the Diesel engine, showing ignition lag followed by the usual sharply rising peak pressures resulting from the explosive character of the auto ignition. A typical two cycle diagram is illustrated and modified according to the present invention to show the diminishing pressure relationship between cylinder pressure c and compression storage chamber pressure d, all as a result of storage of a substantial volume of combustion supporting gases in what will be termed a low compression storage chamber X and using the same during the power cycle, after auto ignition by means of compressing a limited volume of gases in the ignition chamber Y comprising the upper portion of the cylinder.

Figure 1:
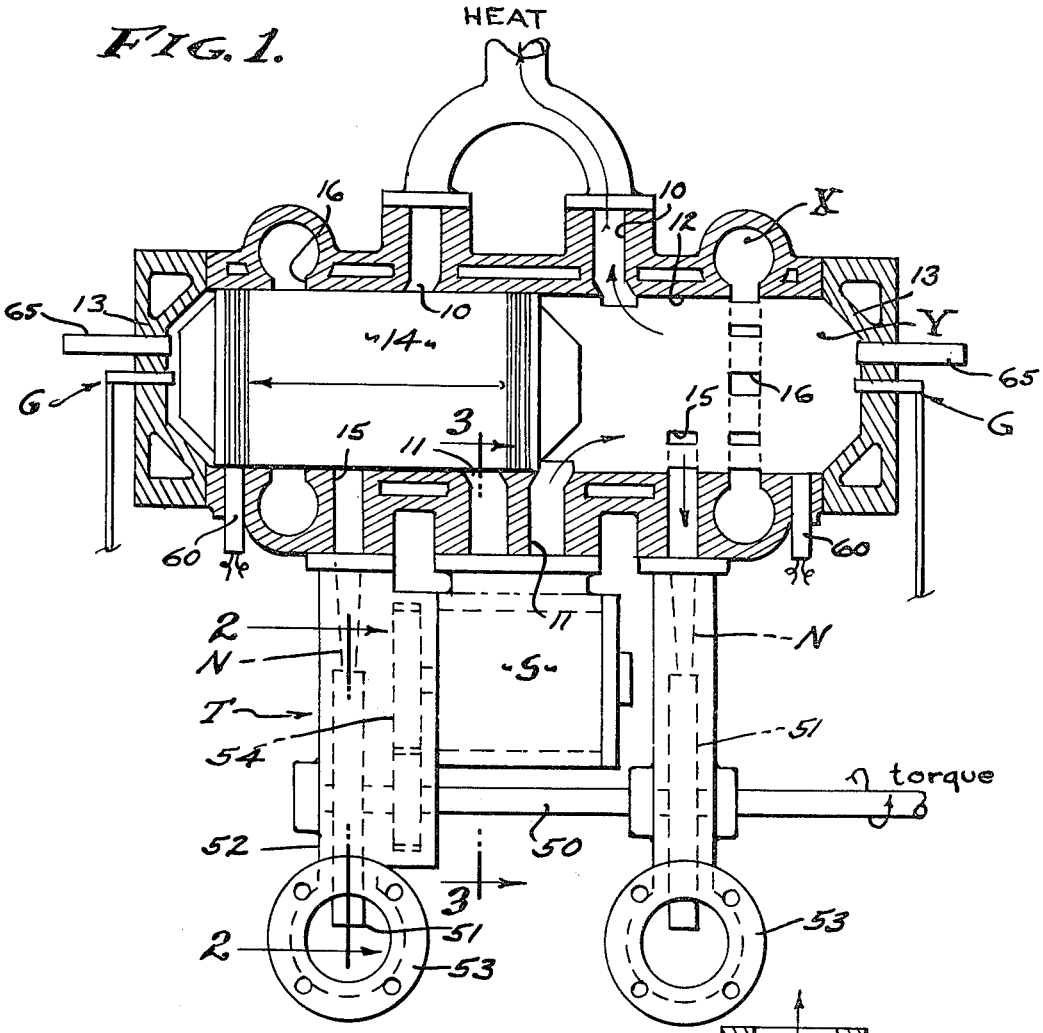
FIG. 1 is a side sectional elevation of the free piston-turbine auto ignition engine of the present invention.

Referring to FIG. 1 of the drawings, this composite engine involves a double ended cylinder 12 closed by opposite heads 13 and in which a double headed piston 14 reciprocates between two combustion chambers. In accordance with this invention, I provide a constant volume variable potency fuel injection means Z operating in timed relation to reciprocation of the piston 14 to inject fuel into the auto ignition chamber Y thereof. The low compression storage chamber X opens through ports 16 into the cylinder 12 at a position substantially midway of the power stroke of the piston 14 and well below the peak compression position thereof. The position of the ports 16 will depend upon the percentage volume of compressed intake air to be stored as compared with the volume of intake air to be finally compressed for auto ignition in chamber Y.

The cylinder 12 is to be considered as horizontally disposed with a head 13 closing the same at each of its opposite ends, and the piston 14 as a member slideable in the cylinder and provided with domed heads at its opposite ends for the deflection of loop flow scavenge air and to shape the ignition chamber Y. The details of construction are not shown, however this free piston engine cylinder is characterized by its two cycle features including an exhaust port 10 and an inlet port 11, one diametrically opposite the other and opening laterally from the cylinder chamber. In practice, the exhaust port 10 is nearer to the head 13 than the inlet port 11 and both of which are uncovered by movement of the piston through the end portion of the power stroke. It is to be understood that there are separate exhaust and inlet ports for each opposite end of the cylinder and piston arrangement, whereby burned gases under pressure can firstly escape through the exhaust port 10 when uncovered by the power piston 14, whereby scavenge air under blower pressure can secondly enter through the inlet port 11 when it too is uncovered by the piston, and thirdly and fourthly whereby the inlet and exhaust ports are sequentially closed during the inlet and compression phases of engine operation.

The total swept volume of the cylinder 12 is not compressed in the usually accepted manner, as compression air is stored when the piston 14 is at or passes through an intermediate position, whereby reducing the aforesaid use of excess air. In the Pressure Volume diagram of FIG. 4 the position of ports 16 is indicated such that they are closed by piston 14 between 80% and 90% of volume, in which case 10% of the partially compressed intake air remains in the auto ignition chamber Y for final compression, the low compression storage chamber ports 16 being closed by the piston 14 to entrap the said 80%–90% partially compressed or low compression intake air as represented by line a.

From the foregoing it will be seen that the minimized, for example 10%, intake air is compressed to auto ignition temperature and ignites injected fuel as the piston 14 reaches its peak compression position, and due to the minimized volume (10%) of compressed intake air it will be apparent that combustion of a customary full metered amount of fuel will not be supported and would work detrimentally with respect to the present invention as and when the ports 16 are re-opened during the power stroke, since cylinder pressure in excess of storage chamber pressure would prevent re-entry of storage air resulting in inadequate support of continued combustion. Therefore, the constant volume variable potency fuel injection means Z is provided to continuously inject fuel throughout the power stroke and such that cylinder pressure never exceeds storage chamber pressure as clearly depicted by the comparable lines c and d in the Diagram. Thus, compressed stored intake gases for the support of combustion are assured of re-entry into the cylinder 12 when the ports 16 are uncovered by piston 14 and throughout the remainder of the power stroke.

Referring now to the low compression storage chambers X for withholding combustion air from the ignition chambers at each opposite end of the cylinder 12, the cylinder 12 is provided with one or more circumferentially disposed ports 16 positioned substantially below the peak compression position of the piston 14 that reciprocates therein. The longitudinal extent of the port or ports 16 can vary according to design, determining the cut-off position where the pressure of the stored intake air is determined, in the example shown at 90% of volume. In practice, the ports 16 are in the form of a "lantern ring", the piston 14 having rings to seal at either side of the ports on both the compression and power strokes. As shown, the chamber X is a closed chamber that surrounds and is re-opened only into the cylinder 12 through the ports 16 when the piston 14 is on the power stroke at about said 90% volume position. It will be seen that the chamber X breathes intake air through the ports 16. It is to be understood that a multiplicity of or a singular storage chamber X can be disposed laterally at any position around the cylinder and/or along its diameter, for the opening and closing of the port or ports 16 at the piston position desired, for example including ports to be opened and closed sequentially by reciprocal movement of the piston.

Referring now to the high compression auto ignition chamber Y for continuing compression of a minimized portion of the intake air to full compression, the cylinder head 13 with the conventional injector of the means Z is provided to cooperate with the piston 14 after the ports 16 are closed on the compression stroke above the 90% volume position. Therefore, the chamber Y is a conventional combustion chamber, in this instance a primary combustion chamber handling a minimized 10% of the swept volume of the cylinder 12, and subjected therefore to commensurately minimized stress.

In accordance with the present invention there is a gas discharge port 15 at each end of the cylinder 12 intermediate the chamber ports 16 and exhaust ports 10, preferably nearer to the combustion end of the cylinder adjacent to the compression ports 16 respectively. That is, the discharge ports 15 are "high" on the cylinder so that the turbine T next to be described receives driving pressures during a substantial portion of both the work and compression strokes, operating from both ends of the power piston 14 respectively. In practice, the discharge ports 15 are in the form of a "lantern ring", partially for example, and so that expanding gases are alternately bled off the opposite ends of cylinder 12 and under pressure during the power stroke and compression stroke, and at increasing velocity through the nozzles N respectively to power the turbine T.

The discharge of combustion gases during the power stroke, and of intake gases during the compression stroke, through ports 15, diverts energy necessary to power the turbine T for operation of scavenger means S and to apply torque to a power shaft 50 as circumstances require. In practice, the size and position of ports 15 are proportioned dependent upon the requirements of the scavenger means and the amount of torque to be delivered through the power shaft 50; and there are instances where no power is to be taken from shaft 50 except to operate means S, as in the case of drawing maximum heat from the exhausts 10. Accordingly, the power to be derived from this composite heat engine is primarily in the form of heat and secondarily torque for auxiliaries and as may be required.

Figure 2:
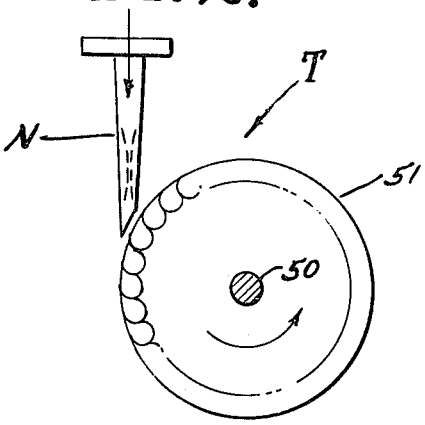
FIG. 2 is a sectional view taken as indicated by line 2—2 on FIG. 1.
Figure 3:
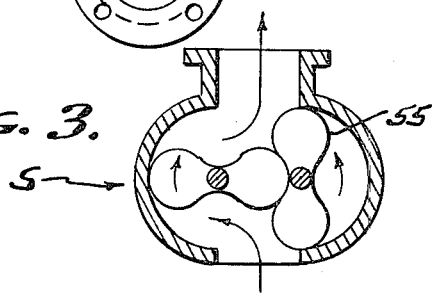
FIG. 3 is a sectional view taken as indicated by line 3—3 on FIG. 1.

The turbine T is provided to respond to the energy discharge through ports 15 to power the shaft 50 and scavenger means S operated thereby. The ports 15 are manifolded to the turbine wheel or wheels 51, and preferably directed to separate wheels 51 spaced on said shaft, as by the nozzles N shown in FIG. 2. As shown, the nozzle and wheel arrangement is that of a turbine which functions on fluid velocity, and which is generally referred to as an impulse turbine. The wheels 51 are housed within cases 52 from which exhaust stacks 53 extend to discharge expended gases to be comingled with the exhaust 10. Thus, as the compression and combustion pressures rise and fall alternately from opposite ends of the cylinder 12, the turbine wheels 51 are rotated efficiently and commensurately with the energy discharged in the form of high velocity gases resulting from the alternate compression and power strokes. Inertia in the wheels maintains a substantially constant angular momentum therein, and through gear reduction means 54 drives the scavenger means S in the form of a positive displacement "Roots" blower 55 or the like (see FIG. 3) delivering compressed air through the inlet ports 11. Thus, the requirements of a blower scavenged two stroke compression ignition are established.

Referring now to the constant volume variable potency fuel injection means Z, a constant stroke and constant volume differential ram pump is operated in timed relation to the engine piston reciprocation. The injection functions are: low pressure metering and homogenous mixing together of discretely small amounts of at least two liquid fuels, one of maximum potency and one of lesser or minimum potency such as a dilutant and/or other additive as may be required; the averaging of power through multiple power strokes, and the constant volume injection which results in full stroke fuel injection and reduced peak pressure; all of which is due to the controllability of relatively small discrete amounts of liquid to be injected. Fuel is injected constantly throughout the effective work stroke of the piston.

The constant volume injection principle is utilized herein, to the end that the Pressure Volume curve of the engine is controlled, and as a consequence making it possible to maintain a cylinder 12 pressure c lower than the storage chamber X pressure d. The injected fuel is a homogenous mixture of at least two liquids, one such as oil or fossil fuel with its full compliment of constituents and properties which afford a maximum power potential commonly rated in British Thermal Units, and one such as water (preferably treated, for example modified or pure or distilled water) with its lesser potency or inert or partially inert properties insofar as combustibility is concerned. In addition to the use of fossil fuels mixed with water, I contemplate the mixture of alcohol and like fuels with water; wherein the water-alcohol will serve as the idling mixture and will have anti-freeze properties. The potency of each power injection is averaged whereby sudden changes are made impossible, while the fuel potency increase or decrease is effected without unreasonable delay, by design in porportioning the differential pump ram as related to the cylinder displacement into which the fuel is injected, and all to the end that peak pressures are reduced so that lighter weight engine structures become permissible, while increasing the potential power output through all speed ranges due to the closer realization of a true constant pressure Diesel cycle.

Each pumping device involves a pump cylinder A, a partition B separating the cylinder into dual chambers, a differential ram C entering the dual chambers respectively and positioning the partition B in the cylinder A, sensor means D driving the same in timed relation to reciprocation of the engine piston 14, a metered fuel supply means E, a metered fuel dilutant supply means F, and a valved injector means G opening into the engine cylinder.

The dual chambers are, a transfer chamber in which the fuel and fuel dilutant are mixed, and a storage chamber in which fuel mixture not injected is re-mixed and stored. The re-mixing and storage concept provides for an averaging of fuel-dilutant potency over a number of engine cycles dependent upon the swept volumes of the said chambers. In practice, the transfer chamber which receives and delivers fluids can have a substantially complete swept volume, whereas the storage chamber which stores previously metered fuel and fuel dilutant has a remaining unswept volume thereby holding consecutively metered changes of fuel-dilutant mixture or portions thereof and mixing and averaging them over a number of engine piston reciprocations.

The pump cylinder A has an inner diameter wall 25 accurately turned about a central axis, the cylinder opening having substantial length and closed at opposite ends by heads 26 and 27, at least one of which is removable for disassembly. The partition B is preferably a piston that is operable in the cylinder A and has an outer diameter wall 19 accurately turned about the central axis and of substantially lesser length than the distance between the heads of the cylinder. The differential ram C that enters the cylinder A is effective in its movement upon the fluids in the aforementioned dual chambers, having differentially sized ram pistons 23 and 24 operable through the heads 26 and 27.

The sensor-drive means D operates the ram C in timed relation to reciprocation of the engine piston 14 and is shown as a piston proximity sensor and motor tappet drive. Sensor probes are located at each ignition chamber Y, in the form of plugs 60 that enter the cylinder wall so as to be exposed to proximity of the piston 14. The sensor-drive means is shown as being electronic, with sensor coils 61 encased in said plugs so as to be juxtaposed to the opposite piston heads closely approaching and/or passing thereby to cover the same. The two coils 61 sense the opposite reciprocal positions of the piston 14, at the peak of the compression stroke in each instance and at which position fuel injection is to be initiated. Accordingly, there is an electronic timer means 62 energized by a power supply 63 such as a battery, and which is responsive to the alternate reciprocal positions of the piston 14 as sensed by the coils 61 so as to generate power pulses or the like for driving a motor M at an angular momentum rate commensurate with reciprocal movement of the said engine piston 14. The motor M is of the synchronous type, a Selsin motor or stepper motor actuated in timed relation to pulses or the like generated by the timer means 62, and turning a shaft 37 of the injector means Z to revolve an injector cam 36 and contactor 50, as will be described.

The ram C has a tappet 35 to engage and follow the cam 36 that revolves with the motor driven shaft 37 at synchronous speed, two cycle timing responsive to the sensor-drive means D as above described. It will be apparent how the lobe of the cam 36 shifts the tappet 35 so as to project the larger ram piston 23 of differential ram C into the uppermost chamber and thereby move the partition B so as to augment said uppermost chamber while diminishing the lowermost chamber while the total displacement is diminished. A return spring 29 returns the tappet, a characteristic feature being control by the shape of cam 36 which is designed to inject fuel at a rate to establish the cylinder pressure curve c that diminishes always at a pressure below that of the storage chamber pressure curve d. The rate of injection as determined by the shape of cam 36 will vary with engine design, to follow and/or establish the pressure curve c.

The metered fuel supply means E and metered fuel dilutant supply means F operate cooperatively to supply or replenish a full injection charge to the uppermost chamber following each constant volume injection therefrom. To this end, the means E involves a valve 30 adapted to intermittently admit fuel, and the means F involves a valve 31 adapted to intermittently admit fuel dilutant. Essentially, the valves 30 and 31 are alike and are opened in inversely balanced degree or for variably balanced time intervals; and for the purpose of completely replenishing the augmenting lowermost chamber. Accordingly, the means E supplies fuel, for example oil, from a constant pressure supply 32; while the means F supplies dilutant for example inert liquid such as mineral oil or water, from a constant pressure supply 33. Depending upon the liquid viscosities involved, the said constant pressures are set at suitable levels and/or the liquids are supplied through orifices of suitable diameter.

Constant pressure is established by means of pumps 34 and 34' that deliver the liquids through pressure regulators 56 and 57 respectively. The amount of delivered liquid in each instance can vary according to the time during which the valves 30 and 31 are fully opened. An electrical potential applied to retract the needle of valve 30 from the valve seat and against a return spring 42 opens each valve inversely varied amounts. The said electrical potential is controllably determined by a rheostat 41 wherein the opposite terminals 43 and 44 of the resistance are connected to valve opening solenoids 45 and 46 respectively, and wherein the moving contact 47 thereof operates between the said terminals. A contactor 50 revolves with the shaft 37 and cam 36 and which conducts current during the intake stroke of the differential ram C and partition B.

The valved injector means G involves a nozzle that opens into the engine cylinder 12 at the combustion chamber Y thereof, and has a check valve (not shown) that prevents the return of fuel-dilutant mixture into the injector. Consequently, the delivery is forward at all times through a tube or the like which delivers a suitably potent charge into the engine cylinder for burning.

From the foregoing it will be seen that I have provided a two cycle free piston compression ignition heat engine characterized by turbo blown scavenging and by the proportioning of intake air divided into separate compressed bodies, one that is stored at a low or moderate compression suitable for the support of combustion of ignited fuel at diminishing pressures, and the other that is highly compressed to auto ignition temperature. In carrying out this invention, the volume of the lower pressured stored air is maximized while the volume of the highly compressed auto ignition air is minimized; the aforesaid 90% to 10% ratio being a typical example only. To these ends therefore, the longitudinal or height position of the port or ports 16 is selected so as to entrap intake air for continued compression to auto ignition temperature, to a pressure employed for auto ignition in Diesel cycle engines. In practice, the auto ignition chamber Y is proportioned and/or sized to initiate combustion at the beginning of the power stroke, during which there is controlled fuel injection supported by the volume of intake air compressed into said auto ignition chamber, and in practice a minor proportion of fuel is injected during this initial portion of the power stroke. Subsequently, as the power stroke progresses and port or ports 16 are opened by piston 14, the substantial volume of storage air from chamber X is made available to re-enter the cylinder 12, following which there is continued controlled fuel injection supported by the volume of intake air previously compressed into said storage chamber, and in practice the major proportion or balance of fuel. It is during both the compression and power strokes that compressed gases are discharge through ports 15 and through nozzles N to operate the turbine T. And in actual practice a positive flow pressure is maintained at the nozzles at all times, as a result of exhaust gas and blower air pressures existent when ports 10 and/or 11 are opened during exhaust and intake cycles of engine operation, and as a result of compression and combustion during those two cycles of engine operation. Since the discharge ports 15 are otherwise open, it is significant that auto cycle ignition is by means of compression within the ignition chamber Y. The cam 36 of the constant volume variable potency fuel injection means Z determines the rate of burning within cylinder 12 and thereby controls the pressure therein so that it complies with the diminishing cylinder pressure curve c that remains below or less than the commensurately diminishing storage pressure curve d. Thus, force is constantly applied throughout the power stroke of the engine, initiated by ignition in the auto ignition chamber Y and followed by and continued at diminishing pressure determined by the storage air pressure that re-enters the cylinder 12 from the storage chamber X. Starting is by means of compressed air injectors 65, as indicated.

Having described only the typical preferred form and application of my invention, I do not wish to be limited or restricted to the specific details herein set forth, but wish to reserve to myself any modifications or variations that may appear to those skilled in the art as set forth within the limits of the following claims:

I claim:

1. A compression ignition and controlled diminishing pressure free piston-turbine scavenged heat engine wherein a double headed piston reciprocates between opposite closed heads of a cylinder and is acted upon by the expansion of burning fuel to apply pressure to opposite heads of the piston and perform work in the form of exhaust heat and torque from said turbine, and including; diametrically opposite laterally opening exhaust and inlet ports spaced from each cylinder head and uncovered by opposite heads of the piston moving through the ends of its power stroke in each instance for two cycle loop scavenging operation, gas discharge ports intermediate the exhaust and inlet ports and the opposite ends of the cylinder for receiving compression and combustion gases from opposite cylinder chambers, auto ignition chambers of minimized volume between said discharge ports and opposite heads of the cylinder of compression of gases to ignition temperature, turbine means alternately receiving compression and combustion gases from said discharge ports respectively, blower means operated by said turbine means and pumping scavenge air through said inlet ports when they are uncovered by the piston for said loop flow scavenging, and a full stroke fuel pump means injecting fuel through opposite heads of the cylinder in timed relation to the piston reaching peak compression positions and continuing injection substantially throughout alternate work strokes respectively.

2. The compression ignition and controlled diminishing pressure free piston-turbine scavenged heat engine as set forth in claim 1, wherein the gas discharge ports open high into the opposite cylinder chambers and closed by piston movement toward opposite heads of the cylinder to establish said auto ignition chambers respectively.

3. The compression ignition and controlled diminishing pressure free piston-turbine scavenged heat engine as set forth in claim 1, wherein the turbine means comprises at least one wheel reacting to the compression and combustion gases delivered through nozzle means from said discharge ports.

4. The compression ignition and controlled diminishing pressure free piston-turbine scavenged heat engine as set forth in claim 1, wherein the turbine means comprises separate wheels reacting to the compression and combustion gases delivered through nozzle means from each of said discharge ports opening from opposite cylinder chambers.

5. The compression ignition and controlled diminishing pressure free piston-turbine scavenged heat engine as set forth in claim 1, wherein the turbine means comprises at least one impulse turbine wheel reacting to the velocity of compression and combustion gases delivered through nozzle means from said discharge ports.

6. The compression ignition and controlled diminishing pressure free piston-turbine scavenged heat engine as set forth in claim 1, wherein the turbine means comprises separate impulse turbine wheels reacting to the compression and combustion gases delivered through nozzle means from each of said discharge ports opening from opposite cylinder chambers.

7. The compression ignition and controlled diminishing pressure free piston-turbine scavenged heat engine as set forth in claim 1, wherein the blower means is positive displacement and alternately delivers compression air through the inlet ports into opposite cylinder chambers.

8. The compression ignition and controlled diminishing pressure free piston-turbine scavenged heat engine as set forth in claim 1, wherein the double headed piston is highly domed at its opposite ends for directing said loop flow scavenging.

9. The compression ignition and controlled diminishing pressure free piston-turbine scavenged heat engine as set forth in claim 1, wherein probes enter the cylinder at the opposite peak compression positions of the piston, there being timed motor means responsive thereto and operating said full stroke fuel pump means.

10. The compression ignition and controlled diminishing pressure free piston-turbine scavenged heat engine as set forth in claim 1, wherein probes enter the cylinder at the opposite peak compression positions of the piston, there being timed motor means responsive thereto and operating said full stroke fuel pump means with control means restricting fuel injection throughout the power stroke.

11. The compression ignition and controlled diminishing pressure free piston-turbine scavenged heat engine as set forth in claim 1, wherein probes enter the cylinder at the opposite peak compression positions of the piston, there being timed motor means responsive thereto and operating said full stroke fuel pump means with control means variably restricting the rate of fuel injection to effect diminishing combustion pressures throughout the power stroke.

12. The compression ignition and controlled diminishing pressure free piston-turbine scavenged heat engine as set forth in claim 1, wherein probes enter the cylinder at the opposite peak compression positions of the piston, there being timed motor means responsive thereto and operating said full stroke fuel pump means with cam control means operated synchronously with operation of the engine and variably restricting the rate of fuel injection to effect diminishing combustion pressures throughout the power stroke.

13. A compression ignition and controlled diminishing pressure free piston-turbine scavenged heat engine wherein a double headed piston reciprocates between opposite closed heads of a cylinder and is acted upon by the expansion of burning fuel to apply pressure to opposite heads of the piston and perform work in the form of exhaust heat and torque from said turbine, and including; diametrically opposite laterally opening exhaust and inlet ports spaced from each cylinder head and uncovered by opposite heads of the piston moving through the ends of its power stroke in each instance for two cycle loop scavenging operation, closed storage chambers opening through transfer ports into the cylinder intermediate the exhaust and inlet ports and opposite heads of the cylinder for the exit and re-entry of gases from and into opposite cylinder chambers and said transfer ports being positioned for closure by the opposite piston heads and the entrapment of gases in said storage chambers at combustion supporting pressure, gas discharge ports intermediate the exhaust and inlet ports and the storage chamber ports for receiving compression and combustion gases from opposite cylinder chambers, auto ignition chambers of minimized volume between said discharge ports and opposite heads of the cylinder for compression of gases to ignition temperature, turbine means alternately receiving compression and combustion gases from said discharge ports respectively, blower means operated by said turbine means and pumping scavenge air through said inlet ports when they are uncovered by the piston for said loop flow scavenging, and a full stroke fuel pump means injecting fuel through opposite heads of the cylinder in timed relation to the piston reaching peak compression positions and continuing injection substantially throughout alternate work strokes respectively.

14. The compression ignition and controlled diminishing pressure free piston-turbine scavenged heat engine as set forth in claim 13, wherein the storage chamber transfer ports open high into the opposite cylinder chambers and closed by piston movement toward opposite heads of the cylinder to establish said auto ignition chambers respectively.

15. The compression ignition and controlled diminishing pressure free piston-turbine scavenged heat engine as set forth in claim 13, wherein the turbine means comprises at least one wheel reacting to the compression and combustion gases delivered through nozzle means from said discharge ports.

16. The compression ignition and controlled diminishing pressure free piston-turbine scavenged heat engine as set forth in claim 13, wherein the turbine means comprises separate wheels reacting to the compression and combustion gases delivered through nozzle means from each of said discharge ports opening from opposite cylinder chambers.

17. The compression ignition and controlled diminishing pressure free piston-turbine scavenged heat engine as set forth in claim 13, wherein the turbine means comprises at least one impulse turbine wheel reacting to the velocity of compression and combustion gases delivered through nozzle means from said discharge ports.

18. The compression ignition and controlled diminishing pressure free piston-turbine scavenged heat engine as set forth in claim 13, wherein the turbine means comprises separate impulse turbine wheels reacting to the compression and combustion gases delivered through nozzle means from each of said discharge ports opening from opposite cylinder chambers.

19. The compression ignition and controlled diminishing pressure free piston-turbine scavenged heat engine as set forth in claim 13, wherein the blower means is positive displacement and alternately delivers compression air through the inlet ports into opposite cylinder chambers.

20. The compression ignition and controlled diminishing pressure free piston-turbine scavenged heat engine as set forth in claim 13, wherein the double headed piston is highly domed at its opposite ends for directing said loop flow scavenging.

21. The compression ignition and controlled diminishing pressure free piston-turbine scavenged heat engine as set forth in claim 13, wherein probes enter the cylinder at the opposite peak compression positions of the piston, there being timed motor means responsive thereto and operating said full stroke fuel pump means.

22. The compression ignition and controlled diminishing pressure free piston-turbine scavenged heat engine as set forth in claim 13, wherein probes enter the cylinder at the opposite peak compression positions of the piston, there being timed motor means responsive thereto and operating said full stroke fuel pump means with control means restricting fuel injection to effect combustion pressures less than the storage chamber pressures.

23. The compression ignition and controlled diminishing pressure free piston-turbine scavenged heat engine as set forth in claim 13, wherein probes enter the cylinder at the opposite peak compression positions of the piston, there being timed motor means responsive thereto and operating said full stroke fuel pump means with control means variably restricting the rate of fuel injection to effect diminishing combustion pressures less than diminishing storage chamber pressures.

24. The compression ignition and controlled diminishing pressure free piston-turbine scavenged heat engine as set forth in claim 13, wherein probes enter the cylinder at the opposite peak compression positions of the piston, there being timed motor means responsive thereto and operating said full stroke fuel pump means with cam control means operated synchronously with operation of the engine and variably restricting the rate of fuel injection to effect diminishing combustion pressures less than diminishing storage chamber pressures.

* * * * *